US008686822B2

(12) United States Patent
Huang et al.

(10) Patent No.: US 8,686,822 B2
(45) Date of Patent: Apr. 1, 2014

(54) SURFACE MOUNTED PULSE TRANSFORMER

(75) Inventors: Lun-Tsu Huang, New Taipei (TW); Cai-Gang Xu, Kunshan (CN); Zhi Lu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/591,252

(22) Filed: Aug. 22, 2012

(65) Prior Publication Data

US 2013/0049914 A1 Feb. 28, 2013

(30) Foreign Application Priority Data

Aug. 22, 2011 (CN) ..... 2011 2 0304774
May 21, 2012 (CN) ..... 2012 2 0227780
Jul. 6, 2012 (CN) ..... 2012 2 0325703

(51) Int. Cl.
*H01F 27/29* (2006.01)
*H01F 27/28* (2006.01)
*H01F 17/04* (2006.01)

(52) U.S. Cl.
USPC ..... 336/192; 336/221; 336/170

(58) Field of Classification Search
USPC ..... 336/192, 83, 170, 222, 187–189, 221
See application file for complete search history.

(56) References Cited

U.S. PATENT DOCUMENTS 6,373,366 B1 * 4/2002 Sato et al. ..... 336/192
6,472,969 B1 10/2002 Hanato
6,522,230 B2 2/2003 Hanato et al.
7,078,988 B2 7/2006 Suzuki et al.
7,256,673 B2 8/2007 Okumura et al.
7,358,842 B1 * 4/2008 Liu ..... 336/83
7,633,366 B2 12/2009 Hirai et al.
7,791,444 B2 9/2010 Tomonari et al.
8,044,753 B2 10/2011 Azuma et al.
8,093,980 B2 1/2012 Asou et al.
2004/0263285 A1 * 12/2004 Suzuki et al. ..... 333/181
2005/0237141 A1 * 10/2005 Hirai et al. ..... 336/83
2008/0224813 A1 * 9/2008 Hirai et al. ..... 336/216
2010/0109827 A1 * 5/2010 Asou et al. ..... 336/192
2010/0148912 A1 6/2010 Nakatani et al.

FOREIGN PATENT DOCUMENTS

JP 04-216603 A * 8/1992
JP 04-364009 A * 12/1992
JP 2003-077730 A * 3/2003

* cited by examiner

*Primary Examiner* — Alexander Talpalatski
*Assistant Examiner* — Mangtin Lian
(74) *Attorney, Agent, or Firm* — Wei Te Chung; Ming Chieh Chang

(57) ABSTRACT

A surface mounted pulse transformer (100) comprising a drum core (1) and a number of coils (3). The drum core includes a core (11), a first flange (12*a*) and a second flange (12*b*) disposed on both ends of the core. The number of coils wind around the core to form a primary coil and a secondary coil. A number of electrodes (40) are formed on surfaces of the first and second flanges and to be connected to an external substrate. The ends of the coils are physically and electrically connected to the electrodes. One of the electrodes has an electrode groove (401) for receiving and positioning one end of the coils.

5 Claims, 6 Drawing Sheets

SURFACE MOUNTED PULSE TRANSFORMER

BACKGROUND OF THE INVENTION

1. Field of the Invention

The present invention relates to a surface mounted pulse transformer.

2. Description of Related Art

U.S. Pat. No. 8,093,980 discloses a surface mounted pulse transformer including a drum type core and a plurality of coils. The drum type core includes a core, a first flange and a second flange disposed on both ends of the core. The plurality of coils wind around the core to form a primary coil and a secondary coil. A plurality of electrodes are formed on surfaces of the first and second flanges and to be connected to an external substrate. The ends of the coils are physically and electrically connected to the electrodes. The electrodes are disposed as plane pads, therefore the ends of the coils are difficult to be positioned and soldered.

U.S. Pat. No. 7,256,673 discloses a common-mode choke coil including a core, first and second conducting wires, and first and second electrode parts. The core includes a winding section and first and second flanges on either end of the core. Each flange has a front surface and a top surface. A pair of grooves are formed in the top surface sloping from a central position on the top surface in a direction toward the winding section. Each electrode part includes a first electrode on one side of the flange and a second electrode on the opposite side of the flange formed by electroplating either side of the top surface of the front surface. A portion of the electrode is, therefore, formed in the groove in the top surface. The top surface portion of the electrode part is the part that connects with conducting traces on external substrate.

SUMMARY OF THE INVENTION

Accordingly, an object of the present invention is to provide a surface mounted pulse transformer could easily position the coils.

In order to achieve the object set forth, the invention provides a surface mounted pulse transformer comprising a drum core and a plurality of coils. The drum core includes a core, a first flange and a second flange disposed on both ends of the core. The plurality of coils wind around the core to form a primary coil and a secondary coil. A plurality of electrodes are formed on surfaces of the first and second flanges and to be connected to a substrate. The ends of the coils are physically and electrically connected to the electrodes. One of the electrodes has an electrode groove for receiving and positioning one end of the coils.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
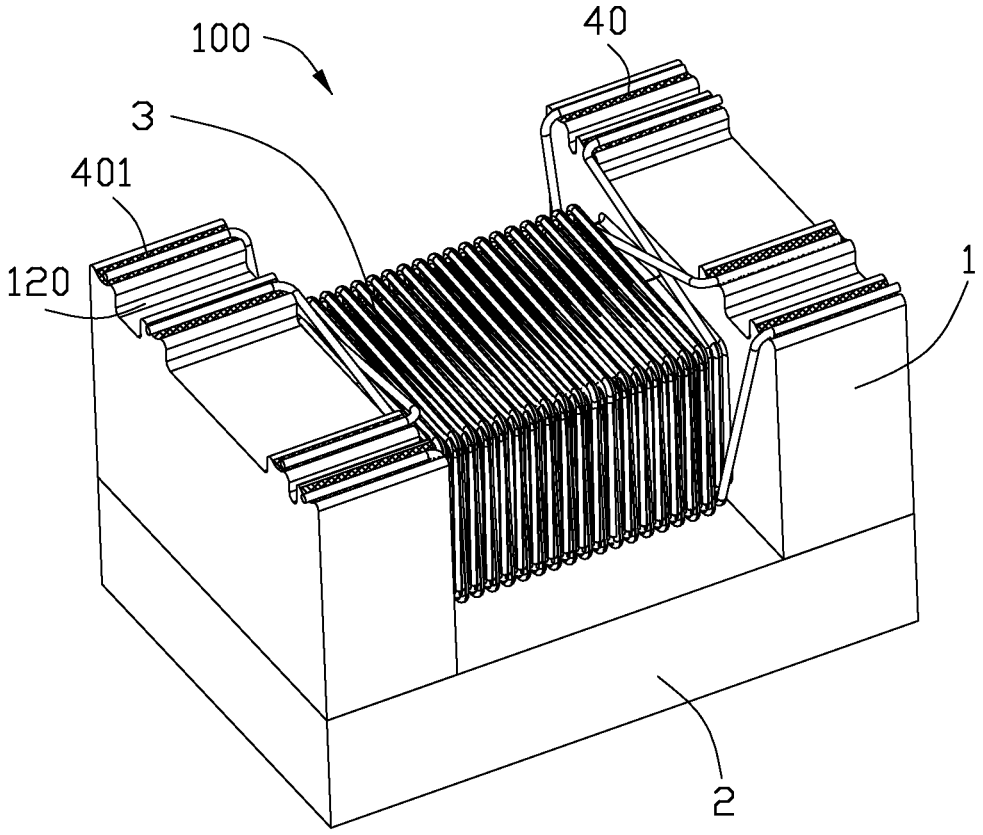
FIG. 1 is a perspective view of a surface mounted pulse transformer in accordance with a first embodiment of the present invention.
Figure 2:
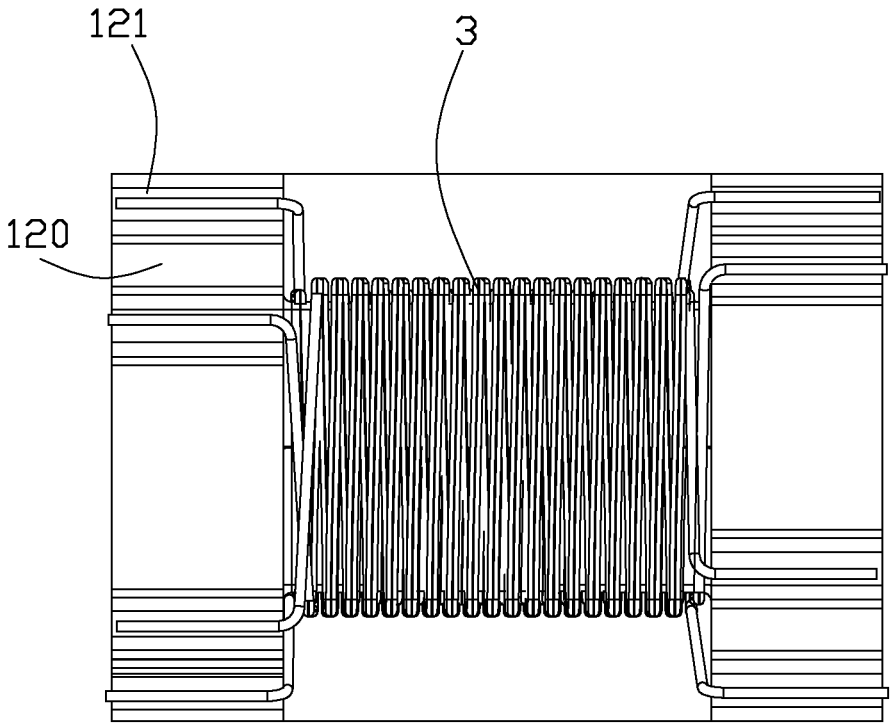
FIG. 2 is plane exploded view of the surface mounted pulse transformer shown in FIG. 1, with electrodes being omitted.
Figure 3:
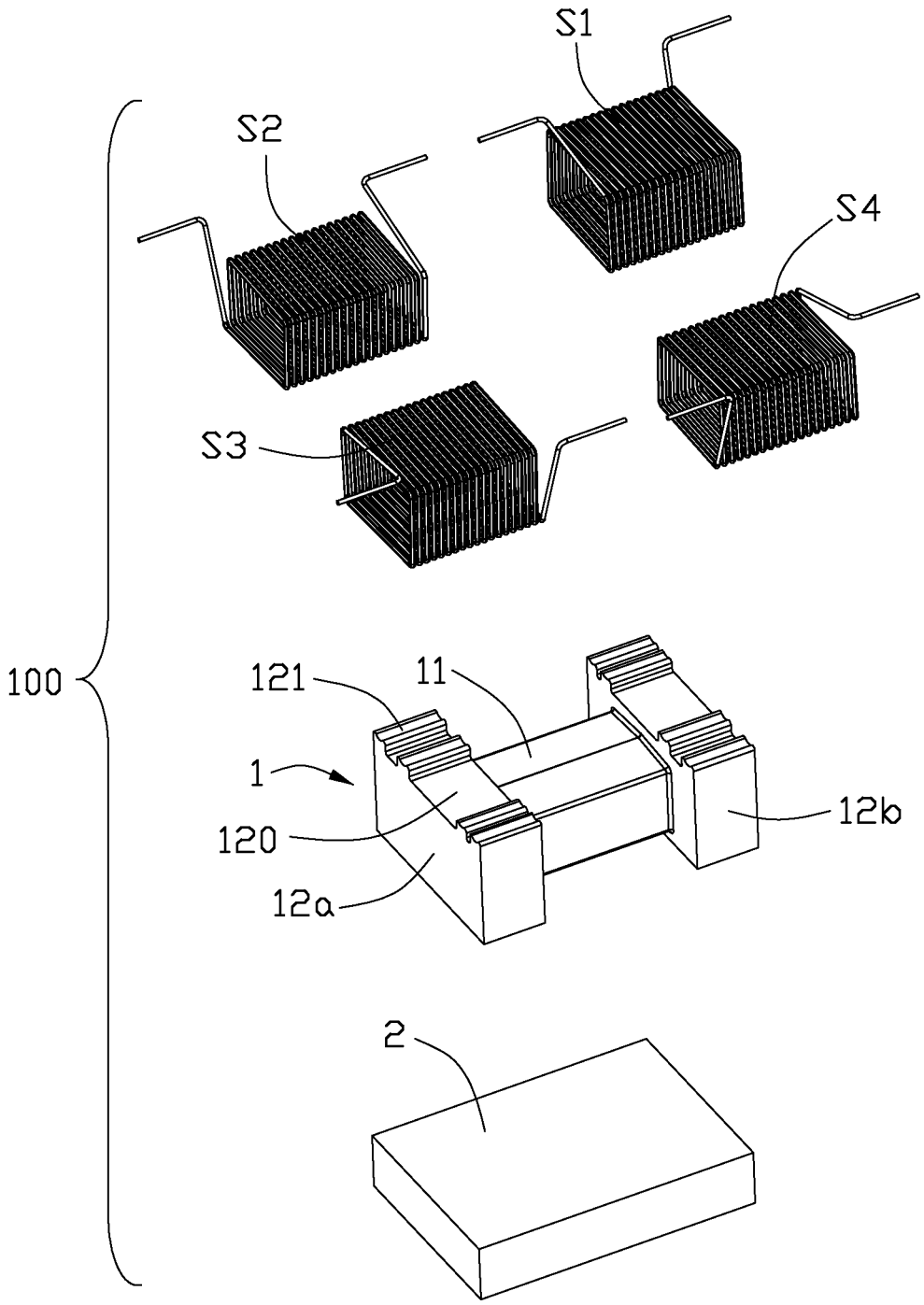
FIG. 3 is an exploded view of a surface mounted pulse transformer shown in FIG. 1, with electrodes being omitted.

Referring to FIGS. 1-3, a surface mounted pulse transformer 100 according to a first embodiment of the present invention. The surface mounted pulse transformer 100 could be mounted to an external substrate. The surface mounted pulse transformer 100 includes a drum core 1, a lid 2 and a plurality of coils 3. The drum core 1 includes a core 11, a first flange 12*a* and a second flange 12*b* disposed on both ends of the core 11. The coils 3 wind around the core 11 to form a primary coil and a secondary coil (FIG. 5).

A plurality of electrodes 40 are formed on surfaces of the first and second flanges 12*a*, 12*b* and to be connected to the external substrate. The first flange 12*a* has four electrodes 40 each having an electrode groove 401 and three recesses 120 each disposed between two electrodes 40. A lower wall of each recess 120 protrudes outwardly from the core 11. The first flange 12*a* has four slots 121 for the electrodes 40 attaching to form the electrode grooves 401. The radius of the electrode groove 401 is greater than the radius of each coil 3. The second flange 12*b* is disposed same as the first flange 12*a*.

Figure 4:
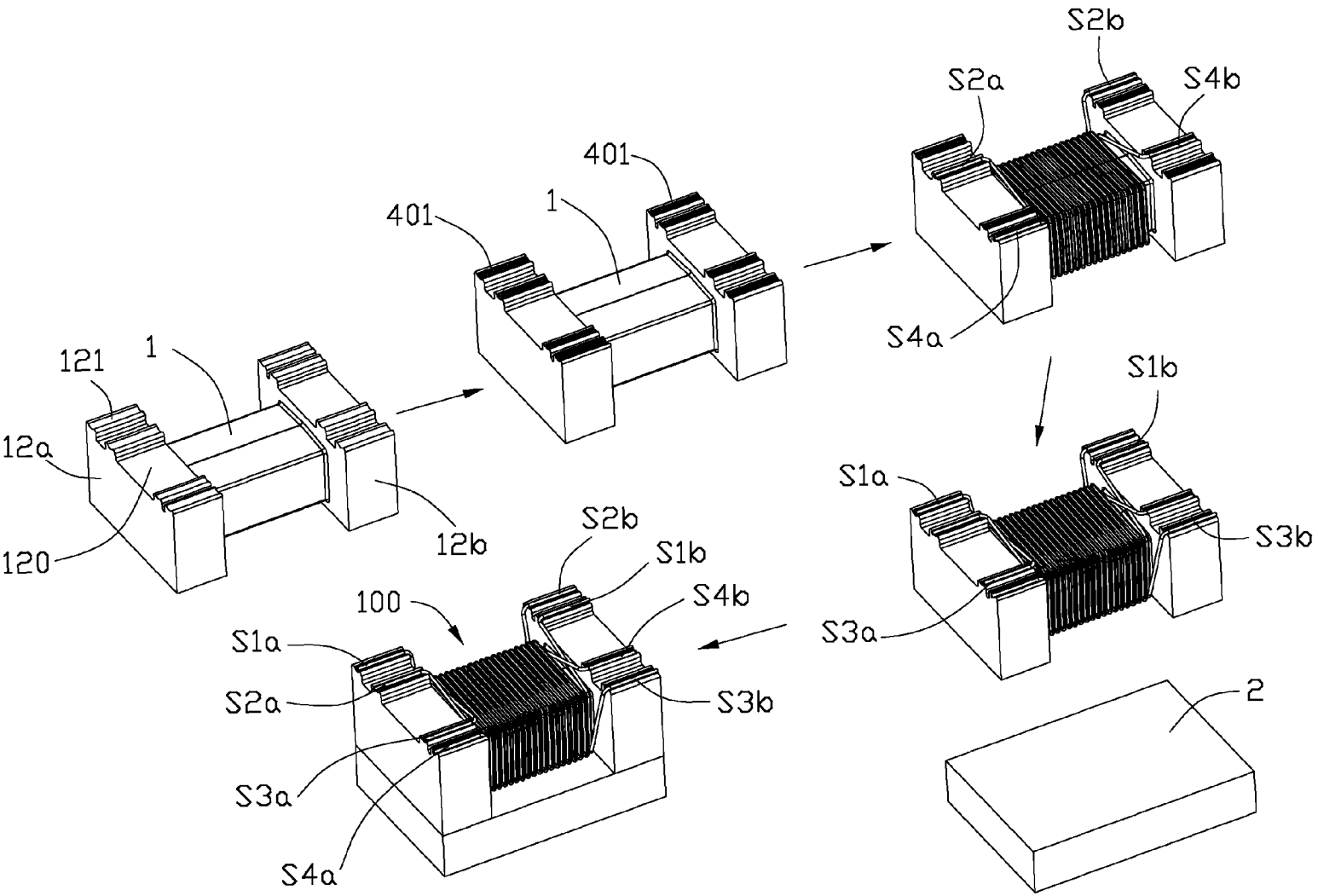
FIG. 4 is a view showing the arrangement of the surface mounted pulse transformer shown in FIG. 3.

Referring to FIGS. 3-4, the plurality of coils 3 comprise a first coil S1, a second coil S2, a third coil S3, and a fourth coil S4 each having a first end S1*a*, S2*a*, S3*a*, S4*a* and a second end S1*b*, S2*b*, S3*b*, S4*b*. The slots 121 of the first and second flanges 12*a*, 12*b* are electroplated to form the electrode grooves 401. The second coil S2 and the fourth coil S4 are wind from the first flange 12*a* to the second flange 12*b* along a clockwise direction. The first coil S1 and the third coil S3 are wind from the first flange 12*a* to the second flange 12*b* along a counterclockwise direction. Four first ends S1*a*, S2*a*, S3*a*, S4*a* are respectively receiving and positioning in the electrode grooves 401 of the first flange 12*a*. Four second ends S1*b*, S2*b*, S3*b*, S4*b* are respectively receiving and positioning in the electrode grooves 401 of the second flange 12*b*. Then, the first and second ends of the coils are physically and electrically connected to the electrodes through hot-melt welding, or they are thermo-compression bonded. The lid 2 is assembled to the drum core 1. The first end S2*a* of the second coil S2 crosses the first end S3*a* of the third coil S3. The second end S4*b* of the fourth coil S4 crosses the second end S1*b* of the first coil S1.

Figure 5:
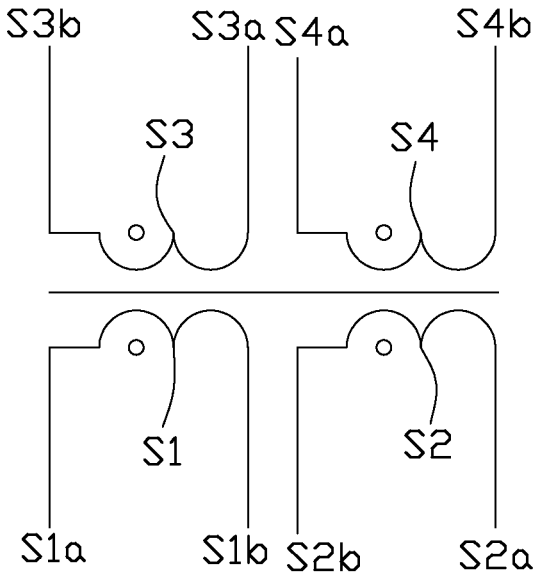
FIG. 5 is a view showing an equivalent circuit of the surface mount pulse transformer shown in FIG. 3.

As shown in FIG. 5, the first and second coils S1, S2 form the primary coil, and the third and fourth coils S3, S4 form the secondary coil.

Figure 6:
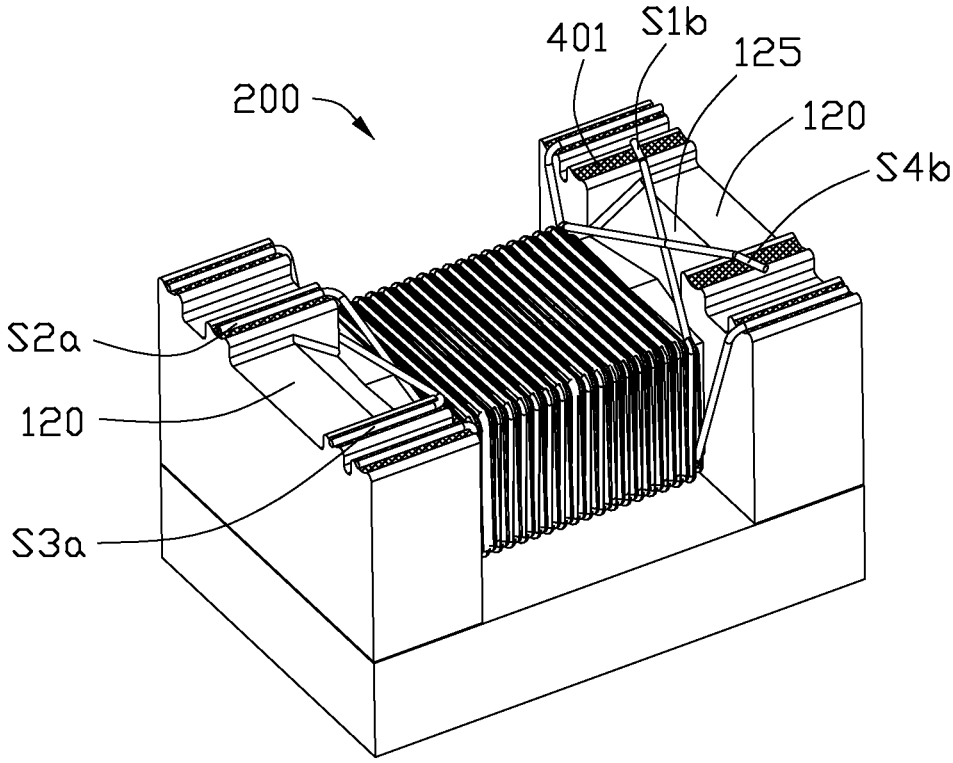
FIG. 6 is a perspective view of a surface mounted pulse transformer in accordance with a second embodiment of the present invention.

Referring to FIG. 6, a surface mounted pulse transformer 200 according to a second embodiment of the present invention. There are several variations compared to the first embodiment as detailed below.

Two second ends S1*b*, S4*b* are respectively connected to two electrode grooves 401 of the second flange 12*b* with certain angle. A lower wall of the recess 120 has a hollow part 125. Compared to the first embodiment, the winding process is made easier and the second ends S1*b*, S4*b* cross each other while keeping a distance therebetween due to the hollow part 125. Two first ends S2*a*, S3*a* are hanged in one recess 120 of the first flange 12*a* for avoiding touching an edge of the first flange 12*a*. Two second ends S1*b*, S4*b* are hanged in one recess 120 of the second flange 12*b* for avoiding touching an edge of the second flange 12*b*.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A surface mounted pulse transformer, comprising:

a drum core including a core, a first flange and a second flange disposed on different positions of the core;

a plurality of coils winding around the core to form a primary coil and a secondary coil; and a plurality of electrodes formed on surfaces of the first and second flanges to be connected to an external substrate, the ends of the coils being physically and electrically connected to the electrodes, respectively;

wherein one of the electrodes defines an electrode groove to receive and position one end of one of the coils therein; wherein said coils include four coils each having two opposite ends respectively fastened to the corresponding electrodes, and two of said four coils are primary coils while the other two are secondary coils;

wherein each of said first flange and said second flange defines four electrodes thereof corresponding to said four coils, respectively, under condition that one of the primary coils and one of the secondary coils commonly rotate clockwise while the other of the primary coils and the other of the secondary coils commonly rotate counterclockwise; wherein input ends of the primary coils and output ends of the secondary coils are located at the first flange while output of the primary coils and input ends of the secondary coils are located at the second flange; wherein on the first flange the electrodes of the input ends of the primary coils are space from each other larger than that between the electrodes of the output ends of the secondary coils, and on the second flange the electrodes of the input ends of the secondary coils are spaced from each other larger than that between the electrodes of the output ends of the primary coils;

wherein on the first flange the electrodes of the input ends of the primary coils are spaced from each other via an empty recess, and the electrodes of the output ends of the secondary coils are spaced from each other via another empty recess.

2. The surface mounted pulse transformer as claimed in claim 1, wherein said empty recess is transversely larger than said another empty recess.

3. The surface mounted pulse transformer as claimed in claim 2, wherein only said one of the primary coils and said one of the secondary coils extend across each other on the first flange, and only said other of the primary coils and said other of the secondary coils extend across each other on the second flange.

4. The surface mounted pulse transformer as claimed in claim 3, wherein all electrodes are equipped with electrode grooves to receive the corresponding ends of the coils, respectively.

5. The surface mounted pulse transformer as claimed in claim 2, wherein on the second flange the electrodes of the input ends of the secondary coils are spaced from each other via an empty recess, which is transversely dimensioned similar to the empty recess between the electrodes of the input ends of the primary coils, and the electrodes of the output ends of the primary coils are spaced from each other via another empty recess, which is transversely dimensioned similar to said another empty recess between the electrodes of the output ends of the secondary coils.

* * * * *